US007811091B2

(12) United States Patent
Koyama

(10) Patent No.: US 7,811,091 B2
(45) Date of Patent: Oct. 12, 2010

(54) ROTARY TERMINAL MECHANISM

(75) Inventor: Junji Koyama, Nagano (JP)

(73) Assignee: Harmonic Drive Systems Inc., Tokyo (JP)

( * ) Notice: Subject to any disclaimer, the term of this patent is extended or adjusted under 35 U.S.C. 154(b) by 0 days.

(21) Appl. No.: 12/227,968

(22) PCT Filed: Jul. 26, 2006

(86) PCT No.: PCT/JP2006/314723

§ 371 (c)(1),
(2), (4) Date: Dec. 3, 2008

(87) PCT Pub. No.: WO2008/012875

PCT Pub. Date: Jan. 31, 2008

(65) Prior Publication Data

US 2010/0003836 A1 Jan. 7, 2010

(51) Int. Cl.
*H01R 39/00* (2006.01)

(52) U.S. Cl. ..... 439/17; 439/19

(58) Field of Classification Search ..... 439/13, 439/17–23, 86, 88

See application file for complete search history.

(56) References Cited

U.S. PATENT DOCUMENTS 5,853,294 A * 12/1998 Rehder ..... 439/17
5,923,114 A * 7/1999 Senni ..... 310/232
6,299,454 B1 * 10/2001 Henderson et al. ..... 439/19
6,612,847 B2 * 9/2003 Canizales, Jr. ..... 439/17
6,921,269 B2 * 7/2005 Johnson et al. ..... 439/13

FOREIGN PATENT DOCUMENTS

| | | |
|---|---|---|
| JP | 47-37112 | 11/1972 |
| JP | 05-082223 | 4/1993 |
| JP | 09-102376 | 4/1997 |
| JP | 10-223346 | 8/1998 |
| JP | 2002-231404 | 8/2002 |

* cited by examiner

*Primary Examiner*—Thanh-Tam T Le
(74) *Attorney, Agent, or Firm*—Flynn, Thiel, Boutell & Tanis, P.C.

(57) ABSTRACT

A rotary terminal mechanism in which a first electroconductive ring is inserted, under a slightly collapsed state, between the circular internal peripheral surface of a first outside electrode and the circular external peripheral surface of a first inside electrode that are arranged concentrically. The first electroconductive ring is kept contacting the first outside electrode and the first inside electrode by the elastic restoring force. When the first outside electrode and the first inside electrode rotate relatively, the first electroconductive ring rolls along the circular internal peripheral surface and the circular external peripheral surface while being kept pressed against these surfaces by the elastic force. Consequently, electrical connection is formed constantly between them even if the first outside electrode and the first inside electrode rotate relatively. A rotary terminal mechanism of simple structure requiring fewer components and being advantageous to miniaturization can thereby be attained.

3 Claims, 2 Drawing Sheets

ROTARY TERMINAL MECHANISM

TECHNICAL FIELD

The present invention relates to a rotary terminal (slip ring) mechanism structured so as to be advantageous to the miniaturization and used in order to transmit electric power or a signal between two rotating elements.

BACKGROUND ART

A slip ring is used in order to ensure a state in which a rotation-side member and a fixed-side member are always kept connected electrically. As the number of poles increases, it becomes necessary to coaxially stack the slip ring in a number corresponding to the number of poles. In a case in which there are few contact points, it is necessary to increase the width of the slip ring and to provide the required contact surface area in order to secure the required transmission capacity. Either approach is detrimental to reducing the thickness of the slip ring because of an increase in the axial length of the ring.

A slip ring suitable for a thickness reduction is disclosed in patent document 1. The slip ring disclosed in the document is configured so that the space between a concentrically arranged moveable-side internal ring and fixed-side external ring is provided with a rotating and revolving planetary gear plate kept in contact with the rings. To ensure that the two rings and the planetary gear plate are kept in contact, an arrangement is adopted in which the rings are elastically held by the planetary gear plate on both sides along the central axis of the rings. A slip ring having this structure can be used to create a multipolar arrangement by placing a plurality of ring pairs composed of internal rings and external rings in a concentric fashion. Increasing the number of planetary gear plates makes it possible to provide the required contact surface area. Accordingly, this arrangement is beneficial to reducing the thickness of the slip ring.

[Patent document 1] Japanese Laid-open Patent Publication No. 5-82223

However, in a slip ring provided with the planetary gear plate of this structure, it is necessary for the internal ring and the external ring to be held on both sides by a planetary gear plate provided with an elastic plate. It is also necessary to place an annular or arcuate retainer between the rings, to attach a shaft to the retainer, and to support the planetary gear plate in a rotatable state by the shaft so that the planetary gear plate can rotate and revolve in the annular space between the two rings. The resulting problem is that the structure becomes more complicated and the number of components increases.

DISCLOSURE OF THE INVENTION

Taking these points into account, an object of the present invention is to provide a rotary terminal mechanism that has a simple structure, requires fewer components, and is advantageous to miniaturization.

Aimed at attaining the stated object, the rotary terminal mechanism of the present invention is characterized in comprising:

an outside electrode provided with a circular internal peripheral surface;

an inside electrode provided with a circular external peripheral surface arranged concentrically at a fixed interval relative to the circular internal peripheral surface; and a plurality of electroconductive rings bendable in the radial direction, which are inserted between the circular internal peripheral surface and the circular external peripheral surface;

wherein the outside diameter of the electroconductive rings is greater than the interval between the circular internal peripheral surface and the circular external peripheral surface;

wherein the electroconductive rings are inserted between the circular internal peripheral surface and the circular external peripheral surface in a state of being bent into an ellipse, are pressed against the circular internal peripheral surface and the circular external peripheral surface by an elastic restoring force thereof, and are allowed to slide along the surfaces thereof in the indicated state; and wherein one of the outside electrode and the inside electrode is a fixed-side electrode, and the other is a rotation-side electrode.

In the rotary terminal mechanism of the present invention, the electroconductive rings are inserted in a slightly bent state between the concentrically arranged circular internal peripheral surface of the outside electrode and circular external peripheral surface of the inside electrode. The electroconductive rings are held by the elastic restoring force thereof in a state of contact with the outside electrode and the inside electrode. When the outside electrode and the inside electrode rotate relative to each other, the electroconductive rings roll (rotate and revolve) along the circular internal peripheral surface and the circular external peripheral surface while being kept pressed against these circumferential surfaces by the elastic force. Consequently, an electrical connection is constantly formed between the outside electrode and the inside electrode when the electrodes rotate relative to each other.

In the rotary terminal mechanism of the present invention, the electrical connection between a fixed-side electrode attached to the fixed-side member and a rotation-side electrode attached to the rotation-side member is maintained using electroconductive rings inserted between the electrodes in a slightly collapsed state. The electroconductive rings may merely be inserted between the two electrodes in the same manner as in a case in which a roller is inserted between the outside race and the inside race of a roller bearing mechanism. A rotary terminal mechanism having a simple structure and a small number of components can thereby be implemented. A multipolar arrangement can be obtained by concentrically arranging numerous sets of fixed-side electrodes and rotation-side electrodes. The contact surface area between two electrodes can also be made larger by increasing the number of electroconductive rings. A rotary terminal mechanism advantageous to miniaturization, particularly a reduction in thickness in the central axial direction, can thereby be implemented.

In view of the above, the present invention is characterized in having retainer spacers arranged between the electroconductive rings in order to maintain a constant interval between the electroconductive rings and to reduce friction loss. A cylindrical object inserted between the circular internal peripheral surface and the circular external peripheral surface in a state in which the object can roll along the surfaces can be used for the retainer spacers. The electroconductive rings can be held at equal angular intervals by providing the retainer spacers.

The present invention is also characterized in that the outside electrode and the inside electrode are ring-shaped electrodes. The rotary terminal mechanism can be easily made into a multipolar arrangement by concentrically arranging the ring-shaped electrodes.

The present invention is further characterized in having a fixed-side case and a rotation-side case provided with an inside end face coaxially disposed facing the inside end face of the fixed-side case at a set interval therefrom, wherein the rotation-side case is supported via a bearing by the fixed-side case in a rotatable state, the fixed-side electrode is attached to the inside end face of the fixed-side case, and the rotation-side electrode is attached to the inside end face of the rotation-side case.

This arrangement is characterized in that an insertion aperture for inserting the electroconductive rings and the retainer spacers between the circular internal peripheral surface of the outside electrode and the circular external peripheral surface of the inside electrode is formed in one of the fixed-side case and the rotation-side case, and the insertion aperture is sealed by a lid member. A rotary terminal mechanism in which the electroconductive rings are inserted can be easily assembled by adopting a structure that is similar to the roller insertion structure of a roller bearing mechanism.

The rotary terminal mechanism of the present invention is also characterized in that pairs of the outside electrodes and the inside electrodes are concentrically arranged in a plural number, and the electroconductive rings are inserted between the outside electrodes and the inside electrodes of the respective pairs. The rotary terminal mechanism can thereby be made into a multipolar arrangement without increasing the thickness in the central axial direction.

To design a multipolar arrangement without increasing the outside diameter of the rotary terminal mechanism, it is sufficient to arrange pairs of the outside electrodes and the inside electrodes in a plural number in the central axial direction of the outside electrodes and the inside electrodes, and to insert the electroconductive rings between the outside electrodes and the inside electrodes of the pairs.

In the rotary terminal mechanism according to the present invention, an electric connection between the fixed-side electrode attached to the fixed-side member and the rotation-side electrode attached to the rotation-side member is maintained using the electroconductive rings inserted in a slightly collapsed state between these electrodes. The electroconductive rings may merely be inserted between the two electrodes in the same manner as in a case in which a roller is inserted between the outside race and the inside race of a roller bearing mechanism. A rotary terminal mechanism having a simple structure and a small number of components can thereby be implemented. A multipolar arrangement can be obtained by concentrically arranging numerous sets of fixed-side electrodes and rotation-side electrodes. Furthermore, it is possible to enlarge the contact surface area between the electrodes by increasing the number of electroconductive rings. A rotary terminal mechanism advantageous to miniaturization, particularly a reduction in thickness in the central axial direction, can thereby be implemented.

BEST MODE FOR CARRYING OUT THE INVENTION

Embodiments of a rotary terminal mechanism to which the present invention has been applied will now be described with reference to the drawings.

Figure 1:
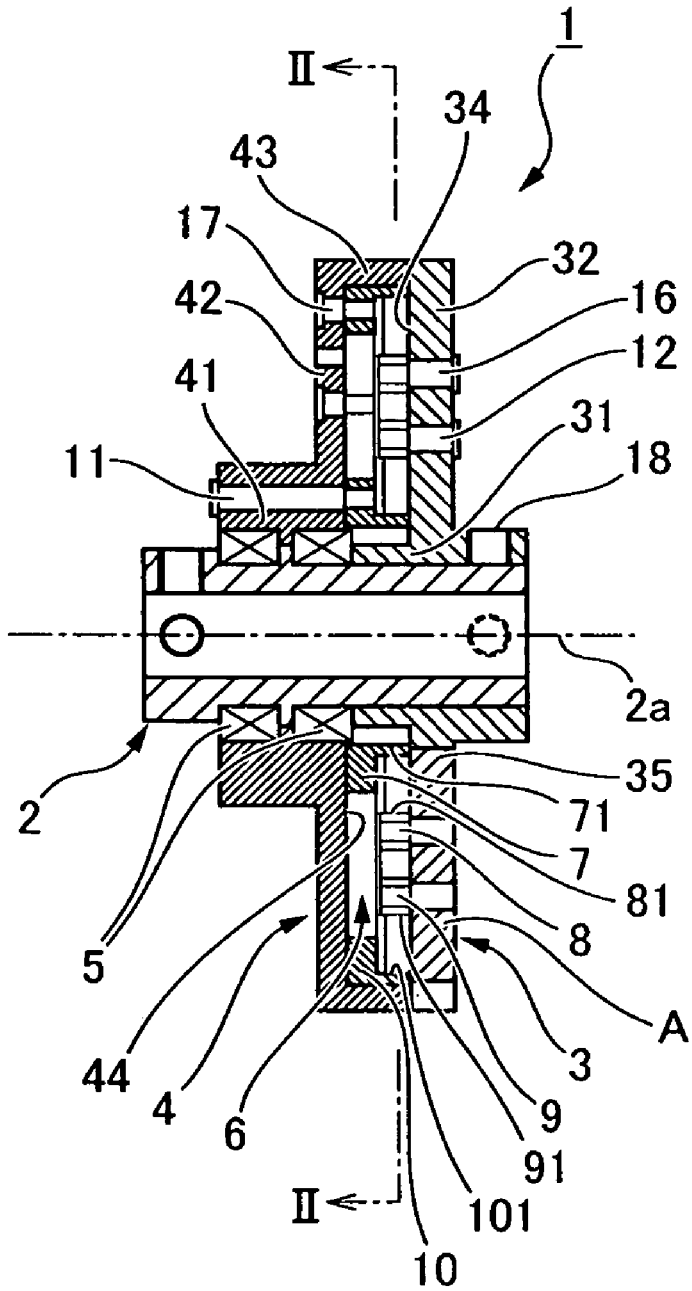
FIG. 1 is a longitudinal sectional view showing a bipolar rotary terminal mechanism to which the present invention has been applied.
Figure 2:
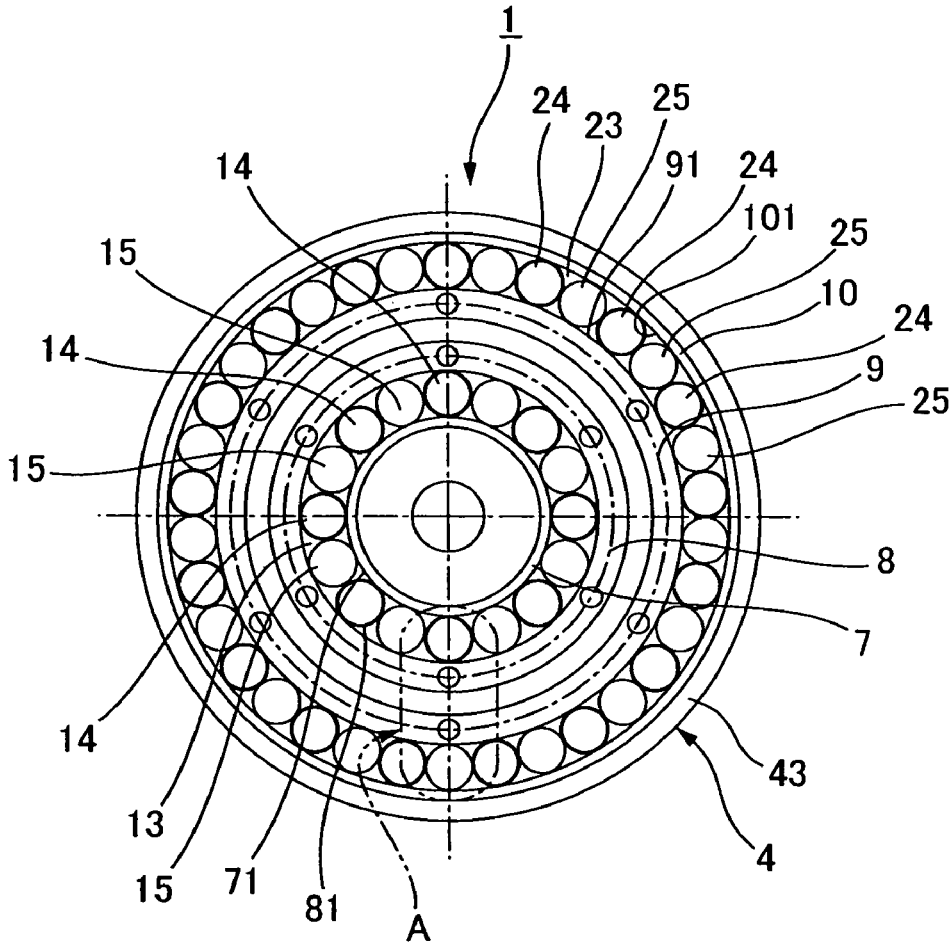
FIG. 2 is a cross-sectional view showing a portion cut along line II-II in FIG. 1.

FIG. 1 is a longitudinal sectional view showing a bipolar rotary terminal mechanism to which the present invention has been applied, and FIG. 2 is a cross-sectional view showing a portion cut along line II-II therein. According to a description made in reference to these drawings, a rotary terminal mechanism 1 is provided with a hollow rotary shaft 2, and an insulating rotation-side case 3 is coaxially fixed to the outer circumference of the hollow rotary shaft 2 by a screw 18. A cylindrical boss 31 provided with a hollow part into which the hollow rotary shaft 2 is fitted, and a rotation-side disc 32 that expands in a direction orthogonal to a central axis 2*a* of the hollow rotary shaft 2 from the outer circumferential surface of the cylindrical boss 31, are integrally formed in the rotation-side case 3.

An insulating fixed-side case 4 is rotatably coaxially attached to the outer circumference of the hollow rotary shaft 2. A cylindrical boss 41 rotatably supported by an outer circumferential surface portion of the hollow rotary shaft 2 via a bearing 5, and a fixed-side disc 42 that expands in the radial direction from an edge of the cylindrical boss 41, are integrally formed in the fixed-side case 4. The fixed-side disc 42 faces a rotation-side disc 32 at a set interval in the direction of the central axis 2*a*, and a cylinder 43 bent at a right angle extending toward the rotation-side disc 32 from the outer circumferential edge of the fixed side disc is integrally formed. The distal end face of the cylinder 43 is slidably pressed against a portion at the external peripheral edge on the inside end face 34 of the rotation-side disc 32.

An annular space 6 having a substantially sealed, longitudinally extended rectangular cross section is formed by the rotation-side case 3 and the fixed-side case 4. A first inside electrode 7, a first outside electrode 8, a second inside electrode 9, and a second outside electrode 10 are concentrically arranged in sequence in the direction from the center toward the interior of the cylindrical space 6.

The first inside electrode 7 is a ring-shaped electrode as a whole, the electrode being fixed to a portion at the inner circumferential rim of an inside end face 44 in the fixed-side disc 42 by a plurality of screws 11. Therefore, the first inside electrode 7 is a fixed-side electrode. The first inside electrode 7 has an L-shaped cross section; merely the portion at the inner circumferential rim has substantially the same width as the cylindrical space 6; and a circular external peripheral surface 71 is formed in the wide portion.

The first outside electrode 8 is a ring-shaped electrode having substantially the same width as the circular external peripheral surface 71 of the first inside electrode 7, and is fixed to the inside end face 34 of the rotation-side disc 32 by a plurality of screws 12. Therefore, the first outside electrode 8 is a rotation-side electrode. A first annular space 13 having a designated width and thickness is formed between a circular internal peripheral surface 81 of the first outside electrode 8 and the circular external peripheral surface 71 of the first inside electrode 7.

A plurality of first electroconductive rings which can be bent in the radial direction, which are eight first electroconductive rings 14 in the example illustrated, are inserted into the first annular space 13. The width of these first electroconductive rings 14 is slightly less than the thickness (dimension in the direction of central axis 2*a*) of the first annular space 13. The outside diameter of the electroconductive rings 14 is slightly greater than the width of the first annular space 13, i.e., the interval between the circular external peripheral surface 71 and the circular internal peripheral surface 81 in the radial direction. The first electroconductive rings 14 are therefore inserted in the first annular space 13 while slightly flexed into an elliptical form, and are pressed against the circular external peripheral surface 71 of the first inside electrode 7 and the circular internal peripheral surface 81 of the first outside electrode 8 by the elastic restoring force thereof. In addition, the electroconductive rings 14 are kept in a state that they are able to roll (rotate and revolve) along the surfaces 71, 81 in the flexed condition.

In the present example, to ensure that the first electroconductive rings 14 can be held inside the first annular space 13 along the circumferential direction thereof at equal angular intervals, oblate cylindrical first retainer spacers 15 are inserted between the first electroconductive rings 14 while in contact therewith. The retainer spacers 15 have substantially the same width as do the first electroconductive rings 14, and the outside diameter thereof is equal to or slightly less than the interval between the circular external peripheral surface 71 of the first inside electrode 7 and the circular internal peripheral surface 81 of the first outside electrode 8. The first retainer spacers 15 can therefore revolve along the circular external peripheral surface 71 and the circular internal peripheral surface 81 in the interior of the first annular space 13. The retainer spacers 15 are formed from an insulating resin.

Next, the second inside electrode 9 is placed on the outside of the first outside electrode 8 at a fixed interval. The second inside electrode 9 has the same cross-sectional shape as does the first outside electrode 8, and is fixed to the rotation-side disc 32 by a plurality of screws 16. The second inside electrode 9 is therefore a rotation-side electrode. The second outside electrode 10 is placed on the outside of the second inside electrode 9 at a fixed interval. The second outside electrode 10 has the same cross-sectional shape as does the first inside electrode 7, and is arranged so that the wide component is positioned at the outer circumferential edge. The second outside electrode 10 is fixed to the fixed-side disc 42 by a screw 17. The second outside electrode 10 is therefore a fixed-side electrode.

A second annular space 23 having the same cross section as does the first annular space 13 is formed between a circular external peripheral surface 91 of the second inside electrode 9 and a circular internal peripheral surface 101 of the second outside electrode 10. In the example shown, a plurality of 17 second electroconductive rings 24 are inserted in the second annular space 23. The second electroconductive rings 24 have the same shape as do the first electroconductive rings 14, and are slightly bent into an elliptical shape and inserted into the second annular space 23.

Oblate cylindrical second retainer spacers 25 made of resin are also disposed between the second electroconductive rings 24. The second retainer spacers 25 have the same shape as the first retainer spacers 15.

A set comprising the first inside electrode 7, the first outside electrode 8, the electroconductive rings 14, and the retainer spacers 15, as well as a set comprising the second inside electrode 9, the second outside electrode 10, the second electroconductive rings 24, and the second retainer spacers 25 are thus concentrically arranged in the rotary terminal mechanism 1 of the present example.

In this arrangement, a slot 35 that is long in the radial direction is formed at location A, marked by a dotted line in FIG. 2, in the rotation-side disc 32 of the rotation-side case 3. The slot 35 is an insertion aperture for inserting the first electroconductive rings 14 and the first retainer spacers 15, as well as the second electroconductive rings 24 and the second retainer spacers 25, into the first annular space 13 and the second annular space 23, respectively. The slot 35 is sealed by an oval-shaped blocking plate 36 having the same profile shape and thickness as the slot. In the present example, the plate is fixed by two screws 12 and 16 to the first outside electrode 8 and the second inside electrode 9, which are themselves fixed to the rotation-side disc 32.

In the bipolar rotary terminal mechanism 1 constructed in this manner, a first fixed-side lead wire (not shown) is brought out from the first inside electrode 7, and a first rotation-side lead wire (not shown) is brought out from the first outside electrode 8. An electrical connection between the lead wires is formed by the first inside electrode 7, the second outside electrode 8, and a plurality of the first electroconductive rings 14 bent into an elliptical shape and inserted therebetween. In the same manner, a second fixed-side lead wire (not shown) is brought out from the second outside electrode 10, and a second rotation-side lead wire (not shown) is brought out from the second inside electrode 9. An electrical connection between the lead wires is formed by the second outside electrode 10, the second inside electrode 9, and a plurality of the second electroconductive rings 24 bent into an elliptical shape and inserted therebetween.

For example, the first electroconductive rings 14 are inserted in a slightly collapsed state between the concentrically arranged circular internal peripheral surface 81 of the first outside electrode 8 and the circular external peripheral surface 71 of the first inside electrode 7. The first electroconductive rings 14 are constantly kept in contact with the first outside electrode 8 and the first inside electrode 7 by the elastic restoring force thereof. When the first outside electrode 8 and the first inside electrode 7 rotate relative to each other, the first electroconductive rings 14 roll (rotate and revolve) along the circular internal peripheral surface 81 and the circular external peripheral surface 71 while being kept pressed against these surfaces 81, 71 by the elastic force. An electrical connection is thereby constantly formed between the first outside electrode 8 and the first inside electrode 7 when the electrodes rotate relative to each other.

The rotary terminal mechanism 1 of the present example can thus be constructed merely by inserting the electroconductive rings 14, 24 between the electrodes 7, 8 and the electrodes 9, 10, respectively, in the same manner as in a case in which a roller is inserted between the outside race and the inside race in a roller bearing mechanism. A rotary terminal mechanism having a simple structure and a small number of components can thereby be implemented. Also, a multipolar arrangement can be obtained by concentrically arranging numerous pairs of fixed-side electrodes and rotation-side electrodes without increasing the thickness in the central axial direction, as in the present example. Furthermore, the contact surface area between two electrodes can be made larger by increasing the number of electroconductive rings. A rotary terminal mechanism advantageous to miniaturization, particularly a reduction in thickness in the central axial direction, can thereby be implemented.

Other Embodiments

The above example describes a bipolar rotary terminal mechanism, but the present invention can also be similarly applied to a rotary terminal mechanism having one pole or three or more poles.

Instead of a plurality of concentrically arranged pairs of inside electrodes and outside electrodes, it is possible to stack the pairs of inside electrodes and outside electrodes in the central axial direction to construct a multipolar rotary terminal mechanism. In this case, a multipolar arrangement can be obtained without bringing about an increase in the outside diameter dimensions.

Furthermore, the above example describes a unit structured so that the hollow rotary shaft 2 of the rotary terminal mechanism 1 is attached to an output shaft of a motor or a rotary output shaft of a rotary actuator. A possible alternative is direct installation to a motor, rotary actuator, or other rotary mechanism. For example, the hollow rotary shaft 2 can be dispensed with, and direct installation to a rotary shaft of a motor can be adopted.

The invention claimed is:

1. A rotary terminal mechanism comprising:

an outside electrode provided with a circular internal peripheral surface;

an inside electrode provided with a circular external peripheral surface arranged concentrically at a fixed interval relative to the circular internal peripheral surface, the outside electrode and the inside electrode being ring-shaped electrodes;

a plurality of electroconductive rings that are flexible in a radial direction thereof and inserted between the circular internal peripheral surface and the circular external peripheral surface, an outside diameter of the electroconductive rings being greater than a gap between the circular internal peripheral surface and the circular external peripheral surface;

retainer spacers arranged between the electroconductive rings for maintaining a constant interval between the respective electroconductive rings, each of the retainer spacers being inserted between the respective adjacent electroconductive rings such that the retainer spacer is in contact with the electroconductive rings;

a fixed-side case; and a rotation-side case provided with an inside end face coaxially disposed facing an inside end face of the fixed-side case at a set interval therefrom, the rotation-side case being supported via a bearing by the fixed-side case in a rotatable state, wherein the electroconductive rings are inserted between the circular internal peripheral surface and the circular external peripheral surface in a state that they are flexed into an ellipse, are pressed against the circular internal peripheral surface and the circular external peripheral surface by an elastic restoring force thereof, and are allowed to roll along the surfaces thereof in the flexed state, one of the outside electrode and the inside electrode is a fixed-side electrode, and the other is a rotation-side-electrode, the fixed-side electrode being attached to the inside end face of the fixed-side case, the rotation-side electrode being attached to the inside end face of the rotation-side case, and one of the fixed-side case and the rotation-side case is formed therein with an insertion aperture for inserting the electroconductive rings and the retainer spacers between the circular internal peripheral surface of the outside electrode and the circular external peripheral surface of the inside electrode, the insertion aperture being sealed by a lid member.

2. The rotary terminal mechanism according to claim 1, wherein pairs of the outside electrodes and the inside electrodes are concentrically arranged in a plural number, and the electroconductive rings are inserted between the outside electrodes and the inside electrodes of the respective pairs.

3. The rotary terminal mechanism according to claim 1, wherein pairs of the outside electrodes and the inside electrodes in a plural number are arranged along a central axial direction of the outside electrodes and the inside electrodes, and the electroconductive rings are inserted between the outside electrodes and the inside electrodes of the respective pairs.

* * * * *